US010540948B2

(12) United States Patent
Marius

(10) Patent No.: US 10,540,948 B2
(45) Date of Patent: Jan. 21, 2020

(54) ERGONOMIC HEAD JOINT FOR A TRANSVERSE FLUTE

(71) Applicant: Tamas G. K. Marius, Monterey, CA (US)

(72) Inventor: Tamas G. K. Marius, Monterey, CA (US)

( * ) Notice: Subject to any disclaimer, the term of this patent is extended or adjusted under 35 U.S.C. 154(b) by 0 days.

(21) Appl. No.: 15/732,669

(22) Filed: Dec. 12, 2017

(65) Prior Publication Data

US 2019/0180724 A1 Jun. 13, 2019

(51) Int. Cl.
*G10D 9/02* (2006.01)
*G10D 7/02* (2006.01)

(52) U.S. Cl.
CPC ..... *G10D 9/02* (2013.01); *G10D 7/026* (2013.01)

(58) Field of Classification Search
CPC ..... G10D 9/02; G10D 7/026
USPC ..... 84/384
See application file for complete search history.

(56) References Cited

U.S. PATENT DOCUMENTS 17,054 A * 4/1857 Pfaff ..... G10D 7/026 84/384
920,471 A * 5/1909 Jenner ..... G10D 7/026 84/384
2,859,555 A * 11/1958 Paige ..... G10D 7/023 446/206
3,062,084 A * 11/1962 Ogilvie ..... G10D 7/026 84/384
3,888,154 A * 6/1975 Wesley, Sr. ..... G10D 7/02 84/384
4,998,456 A * 3/1991 Kahonen ..... G10D 7/005 84/384
5,844,156 A * 12/1998 Nagahara ..... G10D 7/026 84/384
7,825,317 B1 * 11/2010 Lederman ..... G10D 7/005 84/330
8,273,975 B2 * 9/2012 Gisler ..... G10D 7/026 84/384
9,275,614 B2 * 3/2016 Ingalls ..... G10D 9/043
9,613,601 B1 * 4/2017 Minawi ..... G10D 7/026
2007/0044634 A1 * 3/2007 Bear ..... G10D 7/026 84/380 R
2008/0027559 A1 * 1/2008 Crowninshield ..... A61F 2/38 623/23.44
2009/0293701 A1 * 12/2009 Rozier ..... G10D 7/026 84/384
2012/0048094 A1 * 3/2012 Gisler ..... G10D 7/026 84/384
2013/0247745 A1 * 9/2013 Shankar ..... G10D 7/00 84/384
2014/0013925 A1 * 1/2014 Clissold ..... G10D 7/026 84/384

(Continued)

FOREIGN PATENT DOCUMENTS

DE 4242413 C1 * 11/1993 ..... G10D 7/026
DE 4242413 C1 * 11/1993 ..... G10D 7/026
EP 2237265 A1 * 10/2010 ..... G10D 7/026

(Continued)

*Primary Examiner* — David S Warren
*Assistant Examiner* — Christina M Schreiber

(57) ABSTRACT

An ergonomic flute having a head joint that bends slightly downward and away from the user thereby reducing the muscular stress of holding the instrument for long periods of time is disclosed herein.

3 Claims, 13 Drawing Sheets

(56) References Cited

U.S. PATENT DOCUMENTS

| | | | | |
|---|---|---|---|---|
| 2017/0092240 | A1* | 3/2017 | Feliciano | G10D 9/00 |
| 2018/0114511 | A1* | 4/2018 | Shrivastava | G10D 9/043 |

FOREIGN PATENT DOCUMENTS

| | | | | | |
|---|---|---|---|---|---|
| EP | 2237265 | A1 | * | 10/2010 | G10D 7/026 |
| GB | 2040097 | A | * | 8/1980 | G10D 7/02 |
| GB | 2040097 | A | * | 8/1980 | G10D 7/02 |
| GB | 2458144 | A | * | 9/2009 | G10D 7/00 |
| GB | 2458144 | A | * | 9/2009 | G10D 7/00 |

* cited by examiner

ERGONOMIC HEAD JOINT FOR A TRANSVERSE FLUTE

FEDERALLY SPONSORED RESEARCH

Not Applicable

SEQUENCE LISTING OR PROGRAM

Not Applicable

FIELD OF THE INVENTION

The present invention relates generally to the field of wind musical instruments. More particularly, the present invention relates to a specific wind musical instrument, the Western concert flute, having a downward and outward-sloping head joint to relieve muscular stress in the user's back, neck, and arm muscles.

BACKGROUND OF INVENTION & DESCRIPTION OF PRIOR ART

The flute is one of the world's oldest, most common and most widely used instruments.

The flute is in a family of musical instruments in the woodwind group. Typical woodwind instruments like the saxophone and clarinet have reeds in the mouthpiece which generate a sound that is modulated by instrument keys as it moves through the body of the instrument and out of the throat of the instrument. The flute, however, produces its sound from the flow of air across an opening on the body of the flute.

The stream of air flowing across a given hole in the flute creates a vibration of the air moving past that hole. This air stream moving across the hole creates a vacuum or Bernoulli Effect which causes the air moving inside the flute to resonate at a specific frequency. The player, by opening and closing holes along the body of the flute, changes the effective length of the resonator and its corresponding resonant frequency. The holes closest to the mouthpiece have shorter resonators which, in turn, have higher resonant frequencies. On the other hand, the holes farther way from the mouthpiece have longer resonators which, in turn, have lower resonant frequencies.

While many factors affect the acoustic performance and tone of a flute, all variants of the flute have one common factor: their straight cylindrical shape. Whether flutes are end-blown, rim-blown, or side-blown, they all typically have a straight cylindrical shape.

With respect to an end-blown or rim-blown flute, the user positions the instrument directly in front of his/her body so that the instrument is at a right angle to the user's body and parallel to the floor or sloping slightly downward from a virtual plane that is parallel to the floor. The user plays the instrument with both hands while generally keeping the arms close to his or her sides. This natural position is a relatively comfortable position that typically does not cause any muscular stress to the user's arm, neck, or back muscles because the weight of the instrument is supported in part by the user's body.

However, playing a transverse (side-blown) flute, such as the Western Concert flute such as the one shown in FIG. 1, requires the user to hold the flute parallel to the ground and at a right angle to the head. Holding the flute in this manner places the entire weight of the instrument on the user's outstretched arms. Further, the user is now holding the flute in an unnatural position with both arms extended away from the user's body so that the weight of the instrument can no longer be transferred to the user's body. Playing the flute in this position for an extended period will place a great deal of stress on the user's arm, back, and neck muscles which could ultimately lead to discomfort, aches, and cramping.

The prior art contains numerous examples of devices designed to transfer the weight of instruments from the users' arms to their back and shoulders. These devices typically use straps or trusses to transfer the weight of guitars, bassoons, saxophones, and the like to the users' shoulders and/or back. However, no prior art examples contemplate modifying the shape of the instrument to reduce stress on the users' back, neck, and arm muscles. While the flute is one of the oldest instruments known to man it remains one of the more painful ones to play because the prior art has not addressed a solution that relieves the muscular stress caused by holding the instrument is such an unnatural manner.

Objects and Advantages

The present invention seeks to overcome this shortcoming with an ergonomic flute that is simple in design, easy and inexpensive to manufacture, and satisfactory in acoustic tone quality, while still meeting the stated needs of the user for a flute that will create less muscular stress on the user's arms, neck, and back muscles. Accordingly, the objects and advantages of the present invention are:

(1) To provide an ergonomic transverse flute that will overcome the shortcomings of the prior art devices by relieving the stress on the user's arm, neck, and back muscles that is brought on by holding the transverse flute parallel to the floor and outward from the side of the user.

(2) To provide an ergonomic transverse flute that is simple to manufacture, economical in price and easy to maintain.

(3) To provide an ergonomic transverse flute that has a sound quality that cannot be distinguished from that of the prior art devices.

(4) To provide an ergonomic flute that is simple in design, easy and inexpensive to manufacture, easy and safe to use, and commercially reasonable in price.

The features of the present invention were designed to accomplish these goals. The following description of the present invention and the accompanying drawings disclose these features in sufficient detail to allow one skilled in the art to practice the present invention. The following descriptions and accompanying drawings describe only a few of the possible applications of the present invention. The present invention is intended to include these applications, their equivalents, as well as other applications not specifically identified herein. Additional objects, advantages, and novel features of the invention will be set forth in part of the description which follows and will become apparent to those skilled in the art upon examination of the following specification, or will be learned through the practice of the present invention.

DRAWINGS

REFERENCE NUMERALS

10—Flute (with conventional head joint)
100—Flute (with modified head joint)
11—Head joint
110—Body
111—Lip plate
112—Embouchure hole
113—Crown
1131—Head joint cork (not-shown)
1132—Crown outer edge
114—Head joint proximal end
115—Head joint distal end
12—Barrel
13—Body joint
131—Body joint proximal end
132—Body joint distal End
133—Key
14—Foot joint
141—Foot joint proximal end
142—Foot joint distal end

DESCRIPTION OF THE INVENTION

Figure 1A:
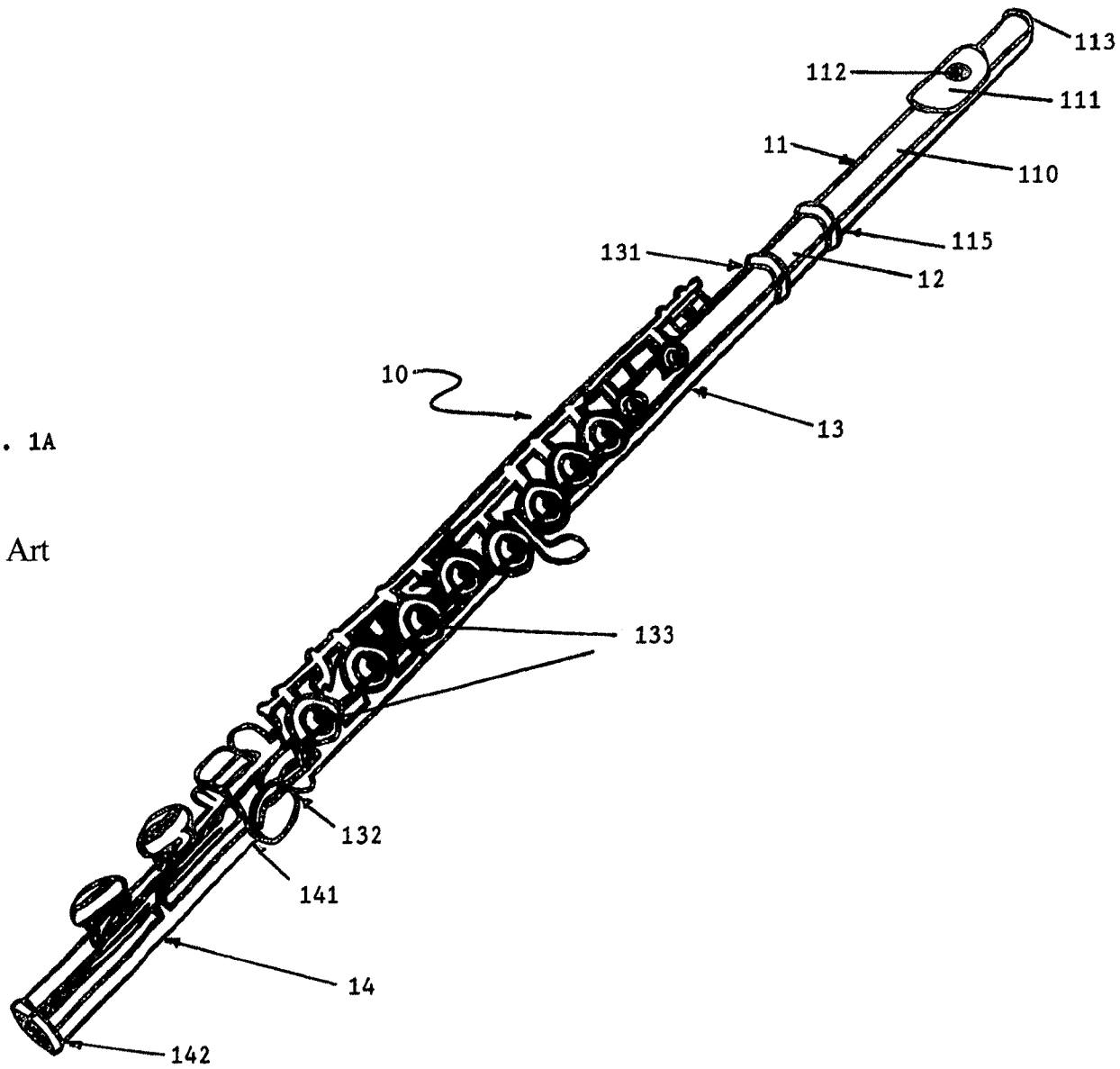
FIG. 1A Prior Art
FIG. 1A is a top-down front perspective view of a typical transverse flute found in the prior art and having a straight head joint.
Figure 1B:
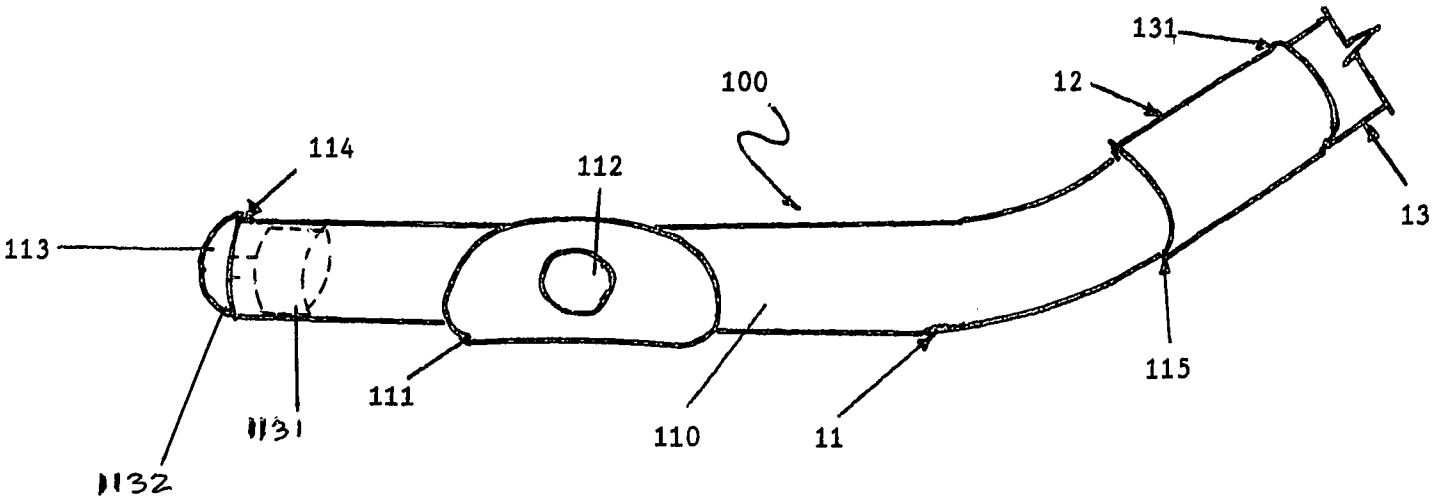
FIG. 1B is a top-down plan view of the present invention on a transverse flute.

FIG. 1A is a top-down front perspective view of a typical transverse flute 10 found in the prior art and FIG. 1B is a top-down plan view of the present invention on a transverse flute 100. The flute 10 depicted in FIG. 1A is a Western Concert Flute which is the type of flute 10 contemplated for use with the present invention. This flute 10 consists of a head joint 11, a body joint 13 and a foot joint 14 joined and held together by surface friction. The crown 113 is a cap at the head joint proximal end 114. Referring to FIG. 1B, the crown 113 is separated from the head joint proximal end 114 by gripping the crown outer edge 1132 and either pulling it outward away from the head joint proximal end 114 or twisting it in a counter-clockwise direction to expose the head joint cork 1131 which is a cylindrical cork that is placed in the top of the head joint 11 to keep air from escaping out of the top of the head joint 11 and is crucial to the tuning and response of the instrument. The crown 113 also helps keep the head joint cork 1131 positioned at the proper depth inside the head joint 11. FIG. 4D, which gives a perspective view of the head joint proximal end 114, also shows the crown 113, the crown outer edge 1132, and the head joint cork 1131.

The head joint distal (tapered) end 115 is tapered to snugly fit into a hollow cylindrical barrel 12 which attaches the head joint 11 to the body joint 13. The inside diameter of the barrel 12 is slightly larger than the outer diameter of the body joint 13 so that when the body joint proximal end 131 of the body joint 13 is inserted into the barrel 12, the fit is a snug fit with no movement of either element after insertion. In variants of the flute 10 that do not contemplate the use of a barrel 12, the head joint distal end 115 would be inserted into the body joint proximal end 131 of the body joint 13 until it comes firmly into contact with the inner surface of the body joint 13 so that the fit is a snug fit with no movement of either element after insertion. The inside diameter of the foot joint 14 is slightly larger than the outer diameter of the body joint 13 so that when the foot joint proximal end 141 of the foot joint 14 is inserted into the body joint distal end 132 of the body joint 13, the fit is a snug fit with no movement of either element after insertion.

The head joint 11 has a lip plate 111 which is the part of the head joint 11 which is in contact with the user's lower lip, allowing the user to position and direct the air stream by blowing a stream of air across the embouchure hole 112. The keys 133 are located on the body joint 13 and are used to change the pitch of the flute 10. Opening or closing keys 133 (which cover circular tone holes—typically 16 tone holes on a concert flutes) changes the pitch. Opening and closing the holes produces higher and lower pitches by changing the effective length of the resonator and its corresponding resonant frequency. The holes closest to the lip plate 111 have shorter resonators which, in turn, have higher resonant frequencies. On the other hand, the holes farther way from the lip plate 111 have longer resonators which, in turn, have lower resonant frequencies.

It should be noted that the mechanical features of the head joint 11 of the present invention are identical to those of the head joint 11 found in the prior art. Specifically, the present invention and the head joint 11 found in the prior art both have a lip plate 111, an embouchure hole 112, a head joint tapered end 115, a crown 113, and a head joint cork 1131. Further, the linear length between the outer edge of the crown 113 and the outer edge of the head joint distal end 115 of the present invention and that of the head joint 11 found in the prior art are the same; similarly, the position of the lip plate 111 and the embouchure hole 112 with respect to the outer edge of the crown 113 on the present invention is identical to the placement of these elements (111, 112) with respect to the crown 113 on the head joint 11 found in the prior art. Finally, the present invention and the head joint 11 found in the prior art will typically be attached to the same type of body joint 13 having similarly positioned keys 133 and foot joint 14. Accordingly, a transverse flute 10 configured with the present invention will have a sound quality that cannot be distinguished from that of a transverse flute 10 configured with a head joint 11 found in the prior art.

Again FIG. 1A is a front top-down perspective view of a prior art head joint 11 attached to the body joint 13 and foot joint 14 of a typical transverse flute 10 while FIG. 1B shows a top-down plan view of the present invention on a transverse flute 10. As mentioned above, the elements and construction of the body joint 13 and the foot joint 14 in FIGS. 1A and 1B are essentially the same and do not constitute elements of the present invention. Instead, they are shown in FIGS. 1A and 1B to give perspective to the dramatic difference between a transverse flute 10 configured with the present invention, i.e., the modified head joint hand a typical transverse flute 10 found in the prior art having a straight head joint 11.

Figure 1C:
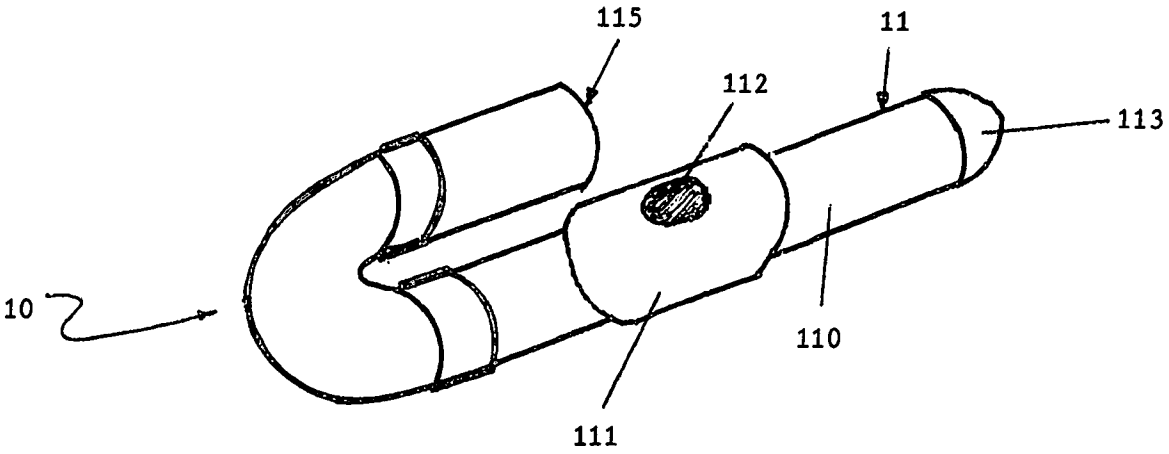
FIG. 1C Prior Art
FIG. 1C is a top-down rear perspective view of the head joint on a child's transverse flute.

FIG. 1C shows a rear top-down perspective view of a head joint 11 typically found on a child's transverse flute 10. This particular head joint 11 is fabricated to accommodate the length of a child's arms which are typically too short to reach the keys 133 near the body joint distal end 132 on a typical transverse flute 10 found in the prior art. However, the body 110 of this head joint 11 is in the same horizontal plane as the rest of the flute 10; accordingly, the juvenile user would still have to hold and position the flute 10 in the same manner as the user depicted in FIG. 2A (below) with the associated problems of the muscular stress caused by holding the instrument is such an unnatural manner. This accommodation solves a different problem than the present invention; specifically, it addresses the problem that the juvenile user's arms are too short to reach all the keys 133 on a typical transverse flute 10 found in the prior art. The physical problems (fatigue, cramps, etc.) associated with holding the flute 10 outward from the body in an unnatural position remain unsolved.

Figure 2A:
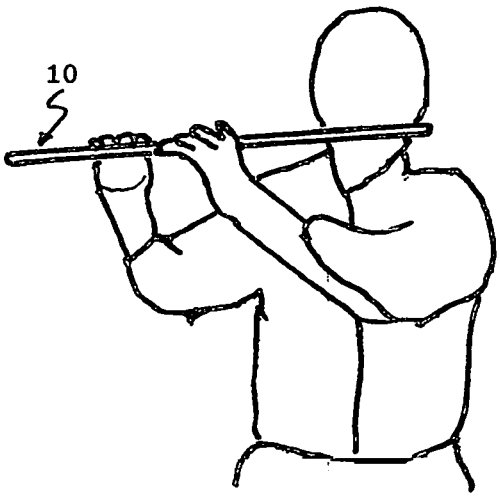
FIG. 2A is a front view of a person holding a transverse flute found in the prior art.
Figure 2B:
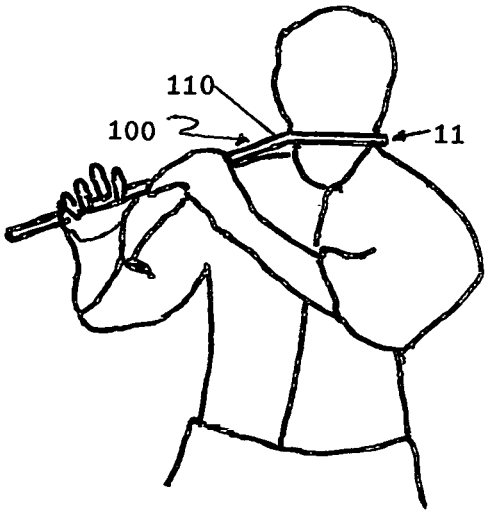
FIG. 2B Prior Art
FIG. 2B is a front view of a person holding a transverse flute configured with the present invention.

FIG. 2A is a front view of a person holding a transverse flute 10 of the type found in the prior art and FIG. 2B is a front view of a person holding a transverse flute 100 configured with the present invention. When viewed side-by-side, FIG. 2A AND FIG. 2B show the difference in the angle of the user's arms. In FIG. 2A, the user's arms are outstretched, and the user's hands are above the shoulders. Holding the arms in this unnatural position for any length of time will typically induce muscular stress in the user's arm, neck, and back muscles that will lead to fatigue and even cramping of those muscle groups. However, in FIG. 2B, the downward sloping angle of the body 110 of the head joint 11 allows the user to hold the flute 100 much closer to the body in a more natural position so that the arms are not outstretched. The downward sloping angle of the head joint 11 allows the user to hold the flute 10 at or below the shoulder. Holding the flute 100 closer to the user's body helps transfer some of the weight of the flute 100 to the user's body instead of relying on the user's arms to support the flute 10 found in the prior art. Holding the flute 100 at or below the shoulder and at a downward sloping angle also helps transfer the weight of the flute 10 to the user's body because the weight force-vector of the flute 100 now has a vertical and a horizontal component instead of just a vertical component.

Figure 2C:
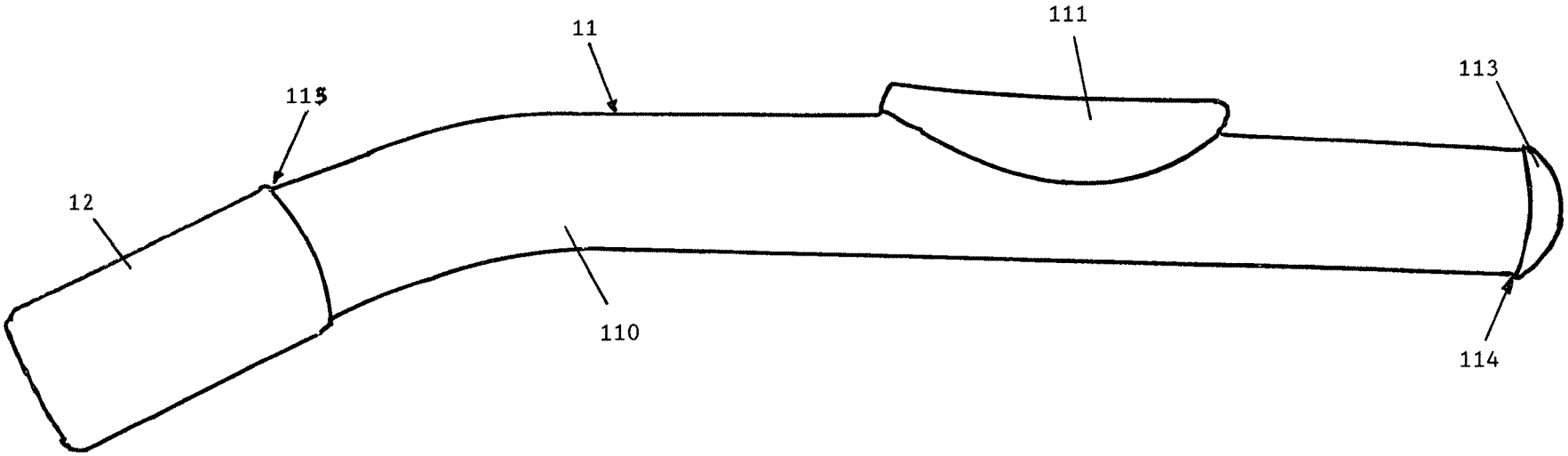
FIG. 2C is a front elevation view of the present invention.

FIG. 2C is a front elevation view of the present invention showing the head joint 11 with its body 110 bending downward at an acute angle from a horizontal plane. While any bending of the head joint 11 downward from the horizontal plane will reduce stress to the user's arm, neck, and back muscles for the reasons discussed in the preceding paragraphs, the goal of the present invention is to achieve the maximum reduction of stress before additional bending begins to induce a different set of muscular stresses as the instrument approaches a more vertical orientation. Informal testing suggests that the optimal downward deviation from the horizontal plane is 30 degrees.

Figure 3A:
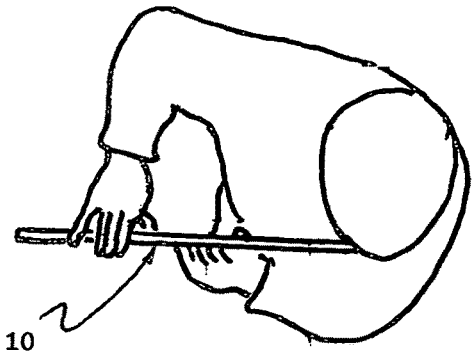
FIG. 3A is top-down view of a person holding a transverse flute found in the prior art.
Figure 3B:
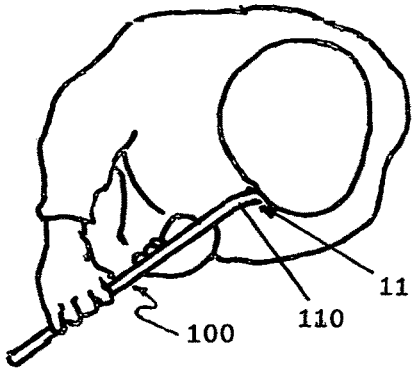
FIG. 3B Prior Art
FIG. 3B is a top-down view of a person holding a transverse flute configured with the present invention.

FIG. 3A is top-down view of a person holding a transverse flute 10 found in the prior art while FIG. 3B is a top-down view of a person holding a transverse flute 100 configured with the present invention. When viewed side-by-side, FIG. 3A AND FIG. 3B show another view of the difference in the angle of the user's arms. In FIG. 3A, the user's arms are outstretched. As discussed previously, holding the arms in this unnatural position for any length of time will typically induce muscular stress in the user's arm, neck, and back muscles that will lead to fatigue and even cramping of those muscle groups. However, in FIG. 3B, the outward-forward (away from the user) angle of the body 110 of the head joint 11 allows the user to hold the flute 100 much closer to the body in a more natural position so that the arms are not outstretched. Holding the flute 100 closer to the user's body helps transfer some of the weight of the flute 100 to the user's body instead of relying on the user's arms to support the flute 100. When viewed together, FIGS. 2B and 3B show the body 110 of the head joint 11 bending downward from a plane parallel to the floor (FIG. 2B) and outward (from the user) from a vertical plane through the user. This bending in two different planes provides the optimum angles for reducing strain on the user's back, neck, and arm muscles.

Figure 3C:
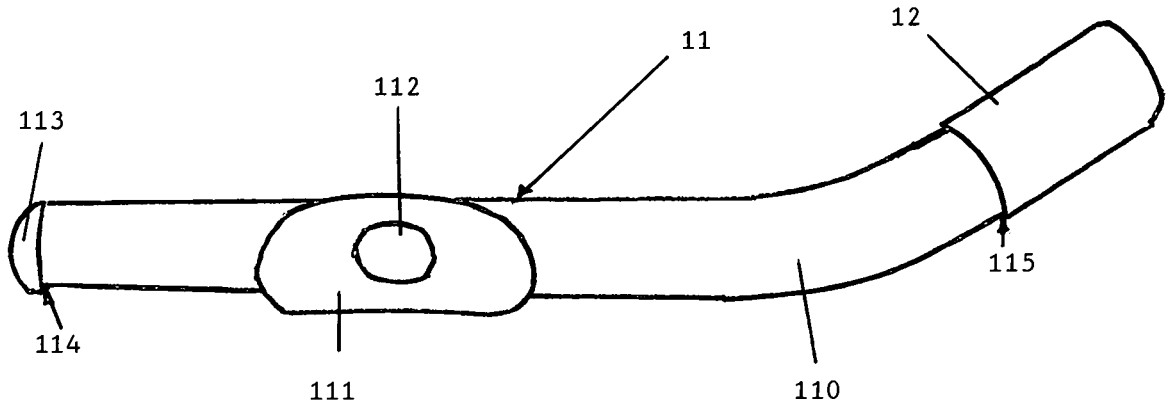
FIG. 3C is a top-down plan view of the present invention.
Figure 3D:
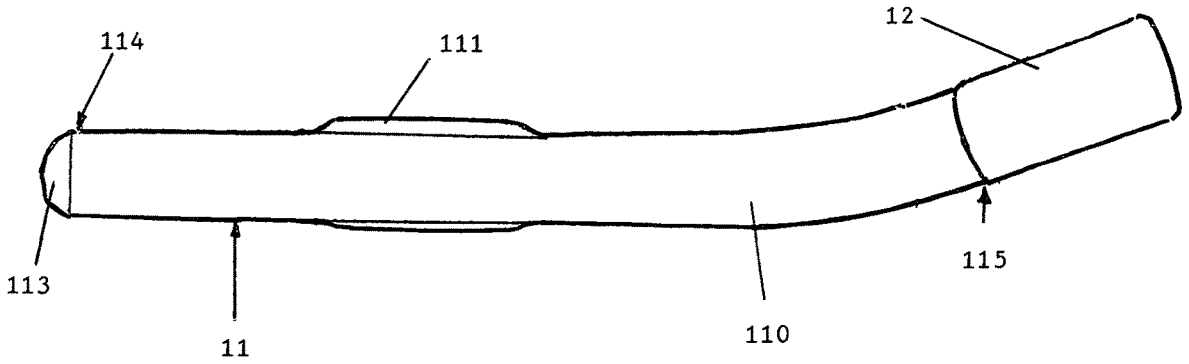
FIG. 3D is a bottom-up plan view of the present invention.

FIG. 3C is a top-down plan view of the present invention and FIG. 3D is a bottom-up plan view of the present invention. FIGS. 3C and 3D show the body 110 of the head joint 11 bending forward and outwards, away from the user at an acute angle from a vertical plane bisecting the user transversely. While any bending of the body 110 of the head joint 11 outward from the vertical plane through the user will reduce stress to the user's arm, neck, and back muscles for the reasons discussed in the preceding paragraphs, the goal of the present invention is to achieve the maximum reduction of stress before additional bending begins to induce a different set of muscular stresses as the instrument approaches an orientation that is perpendicular to its original sideways orientation. Informal testing suggests that the optimal forward and outward deviation from the vertical plane bisecting the user transversely is 25 degrees.

Figure 4A:
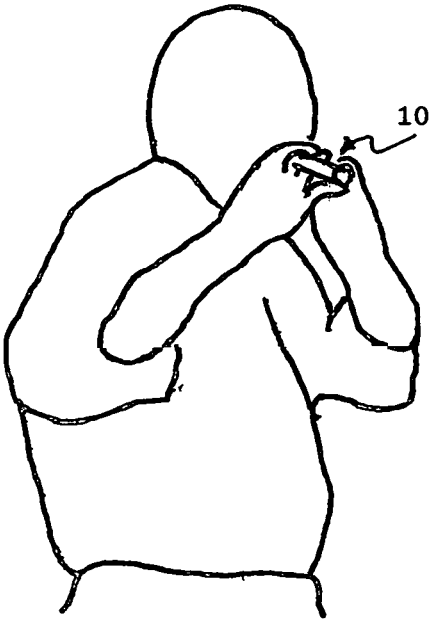
FIG. 4A is a right-side view of a person holding a transverse flute found in the prior art.
Figure 4B:
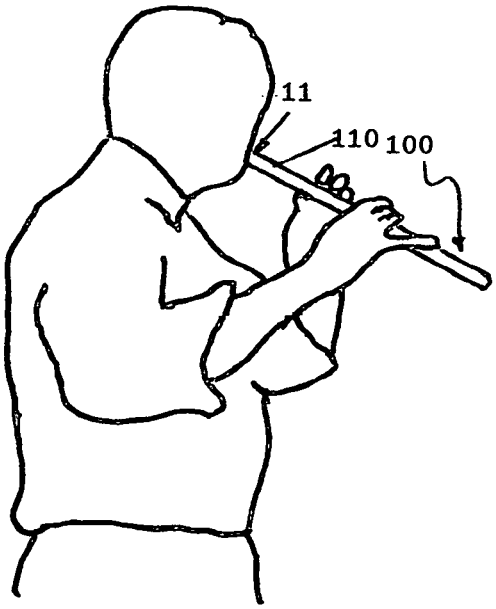
FIG. 4B Prior Art
FIG. 4B is a right-side view of a person holding a transverse flute configured with the present invention.

FIG. 4A is a right-side elevation view of a person holding a transverse flute 10 found in the prior art and FIG. 4B is a right-side elevation view of a person holding a transverse flute 100 configured with the present invention. When viewed side-by-side, FIG. 4A AND FIG. 4B show another view of the difference in the angle of the user's arms. In FIG. 4A, the user's arms are outstretched, and the user's hands are above the shoulder. As discussed previously, holding the arms in this unnatural position for any length of time will typically induce muscular stress in the user's arm, neck, and back muscles that will lead to fatigue and even cramping of those muscle groups. However, in FIG. 4B, the downward angle and outward-forward (away from the user) angle of the body 110 head joint 11 allows the user to hold the flute 100 much closer to the body in a more natural position so that the arms are not outstretched. Holding the flute 100 closer to the user's body helps transfer some of the weight of the flute 10 to the user's body instead of relying on the user's arms to support the flute 100. Holding the flute 100 at or below the shoulder and at a downward sloping angle also helps transfer the weight of the flute 10 to the user's body because the weight force-vector of the flute 100 now has a vertical and a horizontal component instead of just a vertical component.

Figure 4C:
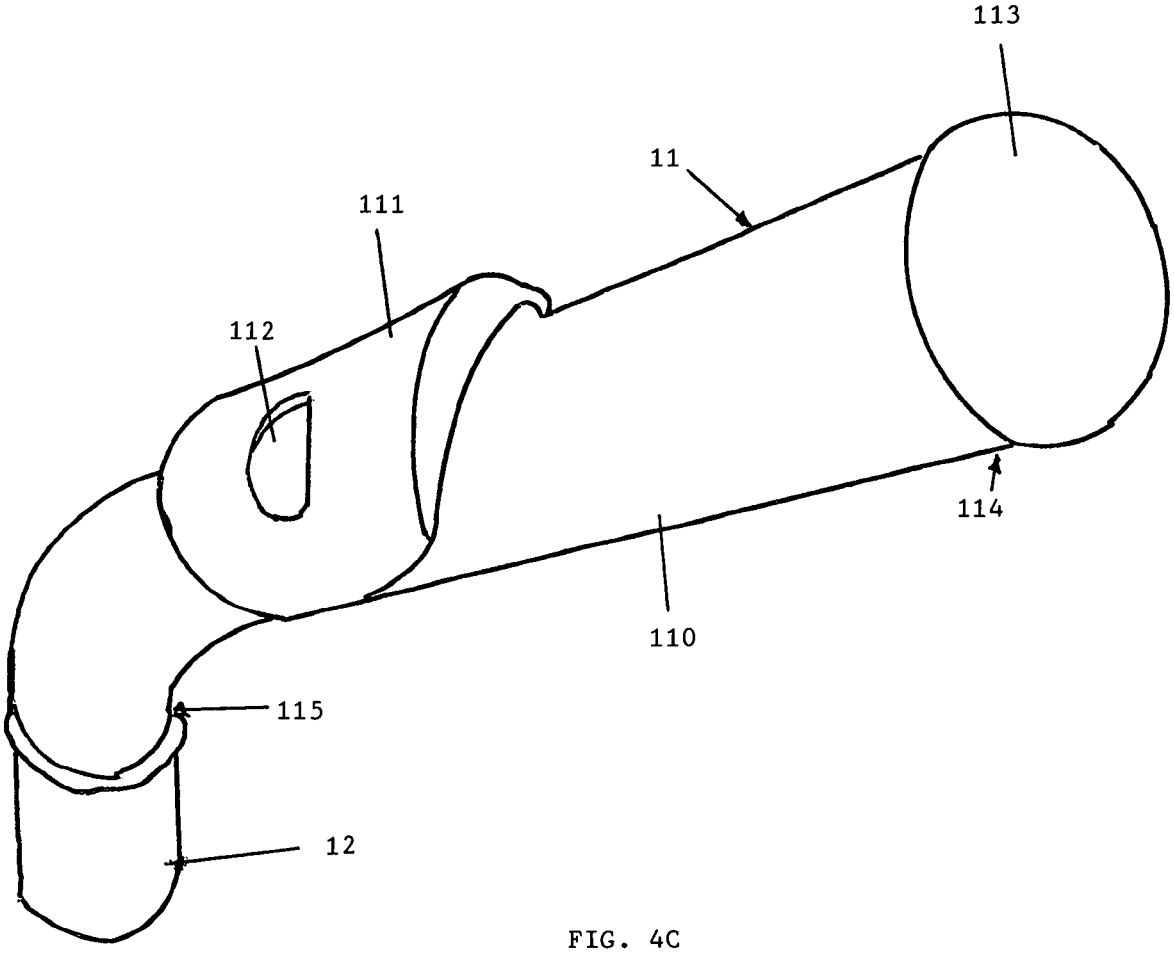
FIG. 4C is a right-side top-down perspective view of the present invention.
Figure 4D:
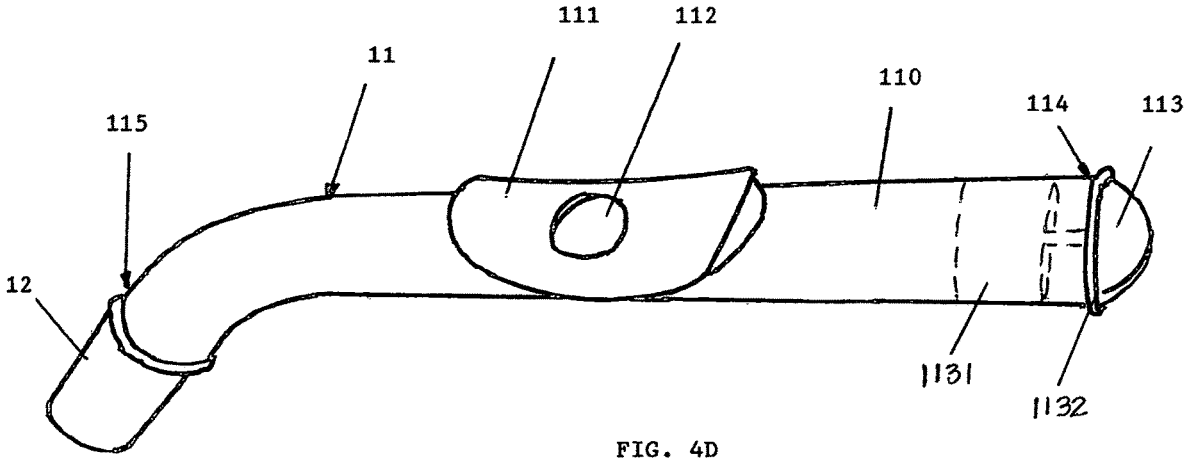
FIG. 4D is a front/right-side top-down perspective view of the present invention.

FIG. 4C is a right-side top-down perspective view of the present invention and FIG. 4D is a front/right-side top-down perspective view of the present invention. FIGS. 4C and 4D show the body 110 of the head joint 11 bending downward as well as forward and outwards, away from the user at an acute angle from a vertical plane bisecting the user transversely. While any bending of the body 110 of the head joint 11 outward from the vertical plane will reduce stress to the user's arm, neck, and back muscles for the reasons discussed in the preceding paragraphs, the goal of the present invention is to achieve the maximum reduction of stress before additional bending begins to induce a different set of muscular stresses as the instrument approaches an orientation that is perpendicular to its original sideways orientation. Informal testing suggests that the optimal forward and outward deviation from the vertical plane bisecting the user transversely is 25 degrees.

FIGS. 4C and 4D also show the body 110 of the head joint 11 bending downward at an acute angle from a horizontal plane that is parallel to the floor. While any bending of the head joint 11 downward from the horizontal plane will reduce stress to the user's arm, neck, and back muscles for the reasons discussed in the preceding paragraphs, the goal of the present invention is to achieve the maximum reduction of stress before additional bending begins to induce a different set of muscular stresses as the instrument approaches a more vertical orientation. Informal testing suggests that the optimal downward deviation from the horizontal plane is 30 degrees.

Figure 5A:
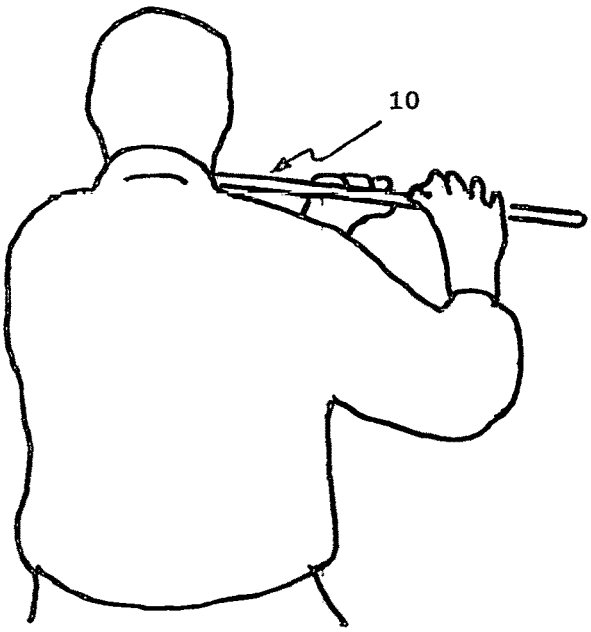
FIG. 5A Prior Art
FIG. 5A is a rear view of a person holding a transverse flute found in the prior art.
Figure 5B:
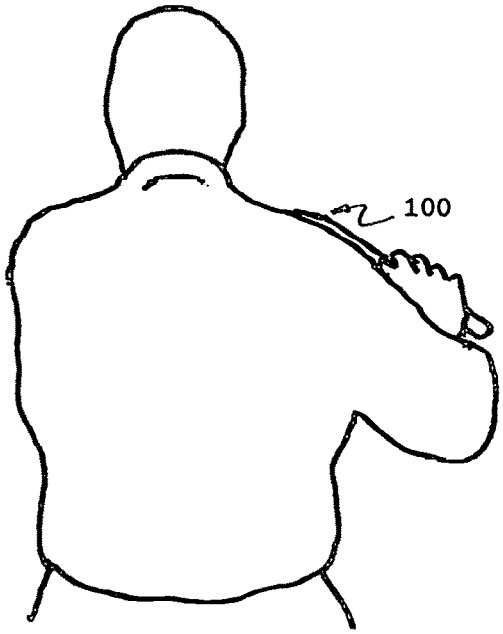
FIG. 5B is a rear view of a person holding a transverse flute configured with the present invention.

FIG. 5A is a rear elevation view of a person holding a transverse flute 10 found in the prior art while FIG. 5B is a rear elevation view of a person holding a transverse flute 100 configured with the present invention. When viewed side-by-side, FIG. 5A AND FIG. 5B show the difference in the angle of the user's arms. In FIG. 5A, the user's arms are outstretched, and the user's hands are above the shoulders. Holding the arms in this unnatural position for any length of time will typically induce muscular stress in the user's arm, neck, and back muscles that will lead to fatigue and even cramping of those muscle groups. However, in FIG. 5B, the downward sloping angle of the body 110 of the head joint 11 (partially obscured by the user's shoulder) allows the user to hold the flute 100 much closer to the body in a more natural position so that the arms are not outstretched. The downward sloping angle of the body 110 of the head joint 11 allows the user to hold the flute 100 at or below the shoulder. Holding the flute 100 closer to the user's body helps transfer some of the weight of the flute 100 to the user's body instead of relying on the user's arms to support the flute 100. Holding the flute 100 at or below the shoulder and at a downward sloping angle also helps transfer the weight of the flute 100 to the user's body because the weight force-vector of the flute 10 now has a vertical and a horizontal component instead of just a vertical component.

Figure 5C:
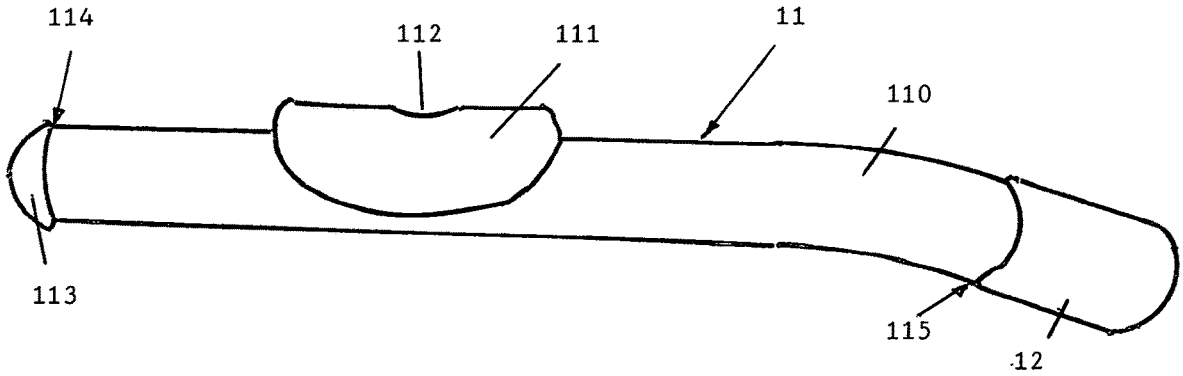
FIG. 5C is a rear elevation view of the present elevation.

FIG. 5C is a rear elevation view of the present invention showing the head joint 11 bending downward at an acute angle from a horizontal plane. While any bending of the body 110 of the head joint 11 downward from the horizontal plane will reduce stress to the user's arm, neck, and back muscles for the reasons discussed in the preceding paragraphs, the goal of the present invention is to achieve the maximum reduction of stress before additional bending begins to induce a different set of muscular stresses as the instrument approaches a more vertical orientation. Informal testing suggests that the optimal downward deviation from the horizontal plane is 30 degrees.

OPERATION OF THE INVENTION

Conclusions, Ramifications, and Scope

The foregoing paragraphs describe an invention that has successively overcome the shortcomings experienced by practitioners of the prior art. The present invention provides the consumer with an ergonometric flute that is simple in design, easy and inexpensive to manufacture, and satisfactory in acoustic tone quality, while still meeting the stated needs of the user for a flute that will create less muscular stress on his or her arms, neck, and back muscles. Accordingly, the objects and advantages of the present invention are:

(1) To provide an ergonomic flute that will overcome the shortcoming of the prior art devices by relieving the stress on the user's arm, neck, and back muscles that is brought on by holding the flute at a right angle to the side of the user'

(2) To provide an ergonomic flute that is simple to manufacture, economical in price and easy to maintain.

(3) To provide an ergonomic flute that has a sound quality that cannot be distinguished from that of the prior art devices.

(4) To provide an ergonomic flute that is simple in design, easy and inexpensive to manufacture, easy and safe to use, and commercially reasonable in price.

The invention claimed is:

1. An ergonomic head joint for a transverse flute that reduces muscular stress experienced by said flute's user, said ergonomic head joint comprising:

a. a hollow, cylindrical, tubular body having a proximal end that is threaded on its inner surface and a distal end that is tapered to snugly and immovably attach it to a body joint of said transverse flute, said distal end of said body curving downward at an acute angle between 0 degrees and 30 degrees from a horizontal plane through said proximal end of said body and curving outward away from said user at an acute angle between 0 degrees and 25 degrees from a transverse vertical plane through said proximal end of said body, b. a hemispherical crown having a threaded base screwing into said proximal end of said body, c. a circular embouchure hole in the top of said body near said proximal end, and d. a semi-cylindrical lip plate having an elliptical aperture centered along its lengthwise axis, said aperture centered over said embouchure hole so as to permit said user, upon placing his lips against said lip plate, to position and direct an air stream by blowing a stream of air across said embouchure hole.

2. The ergonomic head joint for a transverse flute according to claim 1 wherein said body is cast in its angular shape.

3. The ergonomic head joint for a transverse flute according to claim 1 wherein said body is bent into its angular shape.

* * * * *